US008550927B2

(12) United States Patent
Hunter-Jones

(10) Patent No.: US 8,550,927 B2
(45) Date of Patent: Oct. 8, 2013

(54) SOLAR POWERED, SILENT, ENERGY EFFICIENT BABY ROCKER

(76) Inventor: Bridget Hunter-Jones, Lincoln, MA (US)

( * ) Notice: Subject to any disclaimer, the term of this patent is extended or adjusted under 35 U.S.C. 154(b) by 275 days.

(21) Appl. No.: 13/041,978

(22) Filed: Mar. 7, 2011

(65) Prior Publication Data

US 2011/0204689 A1 Aug. 25, 2011

Related U.S. Application Data

(63) Continuation-in-part of application No. 12/911,403, filed on Oct. 25, 2010, now abandoned.

(60) Provisional application No. 61/279,790, filed on Oct. 26, 2009.

(51) Int. Cl.
*A63G 9/16* (2006.01)
*A47D 9/02* (2006.01)

(52) U.S. Cl.
USPC ..... 472/119; 5/108

(58) Field of Classification Search
USPC ..... 472/119–125; 5/108–109; 297/273, 297/281, 260.2
See application file for complete search history.

(56) References Cited

U.S. PATENT DOCUMENTS

| | | | | |
|---|---|---|---|---|
| 3,992,731 | A | 11/1976 | Carswell | |
| 4,793,010 | A | 12/1988 | Gross et al. | |
| 4,881,285 | A | 11/1989 | Zeeb | |
| 6,024,648 | A * | 2/2000 | Shurtleff et al. | 472/119 |
| 6,386,986 | B1 | 5/2002 | Sonner et al. | |
| 6,424,244 | B1 * | 7/2002 | Hendel | 335/177 |
| 6,561,915 | B2 | 5/2003 | Kelly et al. | |
| 6,916,249 | B2 | 7/2005 | Meade | |
| 7,037,205 | B1 | 5/2006 | Bowman | |
| 7,837,570 | B2 * | 11/2010 | Kwon | 472/119 |

* cited by examiner

*Primary Examiner* — Kien Nguyen
(74) *Attorney, Agent, or Firm* — Hamilton, Brook, Smith & Reynolds, P.C.

(57) ABSTRACT

Disclosed is an apparatus for a rocker. In one embodiment, the rocker may be comprised of a fixed support structure; a resonant pendulum suspended from the fixed support structure, a seat or bed suspended on the pendulum; and a coil coupled to the pendulum and interacting with a magnetic field to supply force to the pendulum to maintain movement of the seat or bed. The rocker may also be comprised of a rechargeable battery that is used to power the coil and allow for the rocker to run continuously. The battery may be charged by the coil's interactions with the magnetic field or using at least one solar panel. The solar panel may also be used without a battery to provide energy to the rocker so that it may run continuously. The coil may be comprised of an electrically conducting wire (e.g., copper or aluminum wire).

8 Claims, 3 Drawing Sheets

SOLAR POWERED, SILENT, ENERGY EFFICIENT BABY ROCKER

RELATED APPLICATIONS

This application is a Continuation-in-Part of U.S. application Ser. No. 12/911,403, filed Oct. 25, 2010, now abandoned which claims the benefit of U.S. Provisional Application No. 61/279,790, filed on Oct. 26, 2009.

The entire teachings of the above applications are incorporated herein by reference.

BACKGROUND OF THE INVENTION

Numerous baby rockers and swings that use electric motors and either batteries or a 120 Volt outlet are commercially available. These systems are noisy, not very efficient, and do not run continuously.

SUMMARY OF THE INVENTION

While baby rockers and swings are currently available for purchase, these systems are somewhat noisy and are not energy or time efficient. Example embodiments presented in the present disclosure allow for the use of an actuator coupled to a pendulum. Once the pendulum is pushed, a coil interacts with a magnetic field and then functions as a generator and a motor to maintain the initial amplitude caused by the push. Since the energy required to maintain the motion of the pendulum is low, the actuator and magnetic field are simple, efficient and less noisy. Additionally, in another example embodiment, it is possible to use light from a dimly lit room that may be collected by solar panels as an energy source to charge rechargeable batteries to store energy needed to later power the rocker or swing in the dark.

An example embodiment of the present disclosure includes an apparatus for a rocker comprising: a fixed support structure; a resonant pendulum suspended from the fixed support structure, a seat or bed suspended on the pendulum; and a coil coupled to the pendulum and interacting with a magnetic field to supply force to the pendulum to maintain movement of the seat or bed. The rocker may further comprise a battery to power the coil. The rocker may also further comprise at least one solar panel to charge the battery or to power the coil.

In accordance with the present disclosure, the coil coupled to the pendulum serves as the actuator. The actuator may comprise a coil of copper wire, attached to the pendulum that moves past one or two permanent magnets (north and south). When electrons flow through the coil, the electrons work with the magnetic field from the magnets to produce a force, which drives the pendulum of the rocker. If the direction of the electron flow is reversed, the direction of the force is also reversed. Therefore, by changing the direction of the electron flow, the pendulum is driven back and forth.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Example embodiments of the present disclosure were developed to provide a rocker that may run continuously, be energy efficient, have low power requirements when compared to commercially available rockers, silent, able to harvest energy from light sources, portable, and low cost to manufacture.

Through experimentation of one embodiment, it has been determined that for small angle swings of the pendulum, the power consumed by the rocker is approximately 20 mW. In addition, the pendulum length should be approximately 600 mm to provide a period of approximately 1.5 s for a full period of small pendulum oscillations.

Figure 1A:
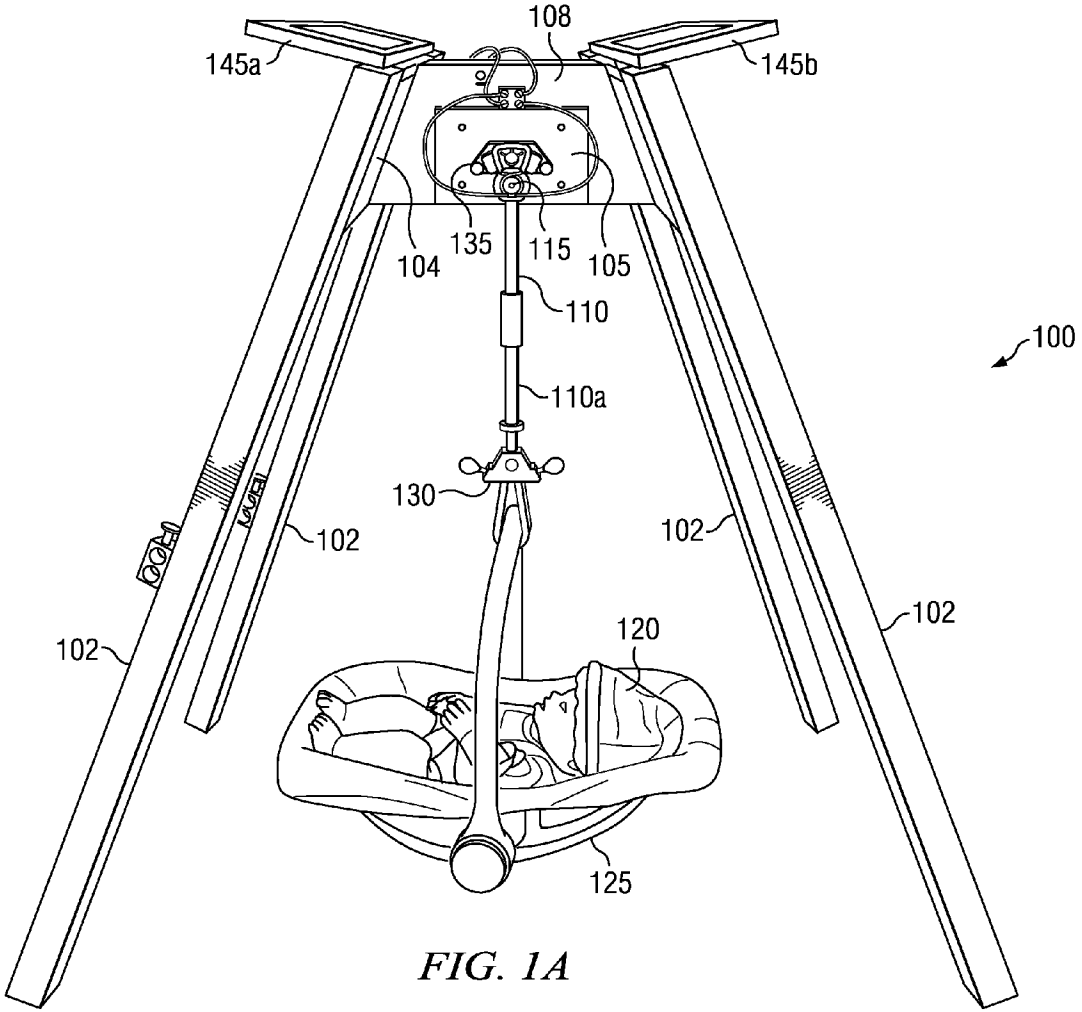
FIG. 1A is a front view of the apparatus in accordance with an embodiment of the present disclosure.
Figure 1B:
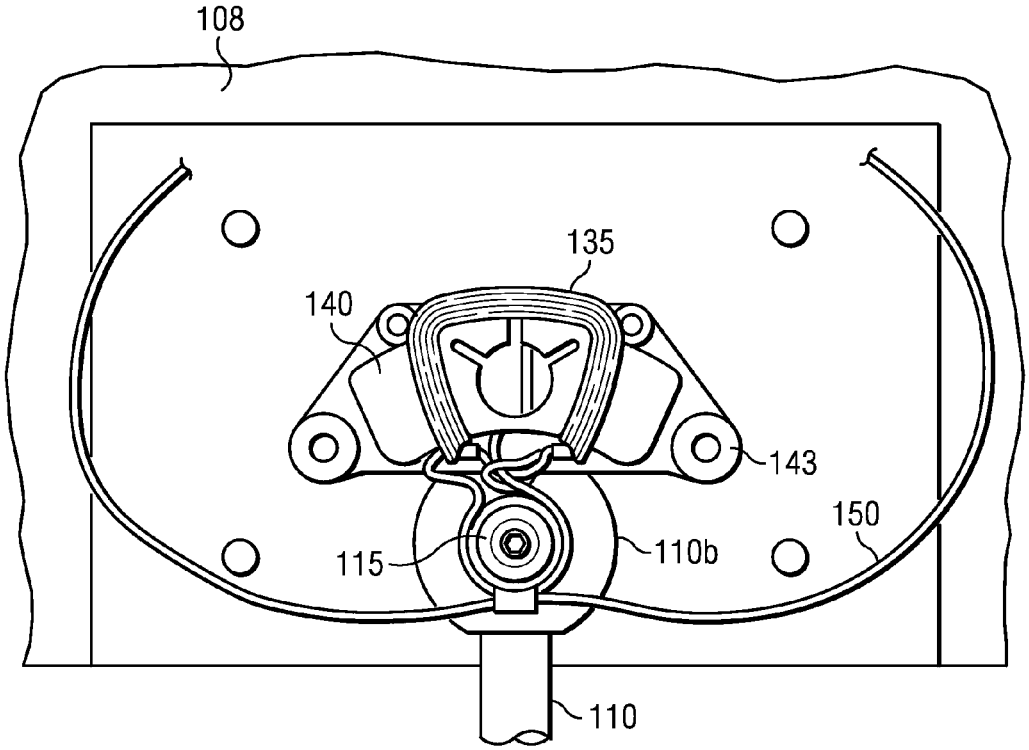
FIG. 1B is a close-up view of the pivot and actuator in the embodiment of FIG. 1A.
Figure 1C:
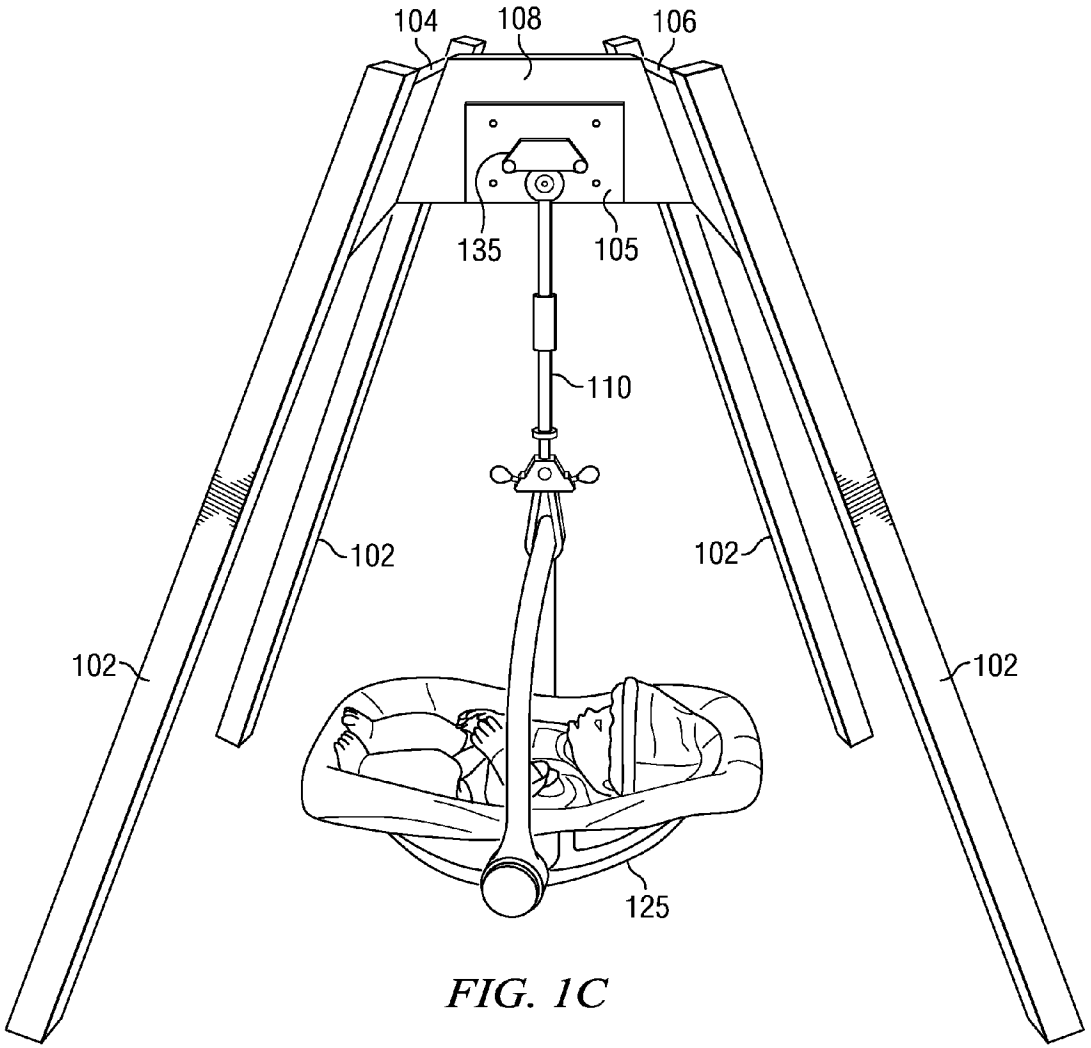
FIG. 1C is a perspective view of the embodiment without detail of the actuator and without solar panels.

FIGS. 1A, 1B and 1C are illustrations of front, close up and perspective views of an example rocker 100 in accordance with an embodiment of the present disclosure.

A stationary support stand comprises four legs 102 joined by cross beams 104, 106 and 108. The rocker 100 may be comprised of a shaft 110, which serves as a pendulum, swinging about a pivot 115. The pivot 115 may be comprised of a bearing (as shown in FIGS. 1A and 1B) or flexure or hinge. One side of the pivot 115 is attached to the frame 105 of the rocker 100 (not shown) and the other side to the shaft. The pivot 115 allows for rotation of the pendulum 110 by up to approximately plus/minus 60 degrees. The shaft 110 has a long part 110*a* and a much shorter part 110*b*. The baby 120 (represented as a doll in FIG. 1A) may be placed on a cot 125, which is attached to the long part 110*a* of the pendulum 110 by a clamp 130. The clamp 130 may be disengaged to allow the cot 125 to be detached from the pendulum 110. The baby 120 can either lay down or sit in the cot 125. The cot 125 may consist of a chair (e.g., a baby's perambulator or car seat as illustrated in FIG. 1A) or bed formed within a basket or similar confinement. The short part 110*b* of the pendulum 110 may be connected to a coil 135 fabricated out of copper or aluminum wire (other forms of electrically conducting wire may also be used). As the pendulum 110 swings, so to does the coil 135. A permanent magnet 140 may be located behind the coil 135 and also in front of the coil (not shown; this second magnet is not required but increases the force generated on the pendulum 110). The permanent magnet 140 that is located behind the coil 135 may be connected to the frame 105 of the rocker 100 using mounting 143, which may be comprised of a plastic material. A small air gap may separate the coil 110 from the magnet(s) 140. The air gap is large enough so that the coil 135 does not touch the magnet 140. The orientation of the magnet(s) 140 is such that their magnetic flux passes through the coil 135 at 90 degrees with respect to current flowing through the coil 135. The interaction of this magnetic flux with the orthogonal electric current causes an orthogonal force to be exerted between the coil 135 and magnet 140. This force is proportional to both current and static magnetic field and is sometimes called the Lorentz force. This Lorentz force causes a rotation of the coil 135/short part 110*b* of the pendulum 110 about the pivot 115 and so in turn causes the long part 110*a* of the pendulum 110 to rotate about the same pivot 115 thus causing the cot 125 to swing. The permanent magnet(s) 140 may be attached to the frame 105 of the rocker 100. If the pendulum 110 is swung by an external force (e.g., the baby's parent) the coil 135 will move relative to the magnet(s) 140 and cause an electrical current to be generated which will be proportional to the angular velocity of the swing.

When a pendulum 110 is pulled back and released, it oscillates back and forth but because of friction (e.g., due to air resistance and bearing flaws) the amplitude of the oscillations slowly decays over time. As such, there is a need for energy to be provided to the rocker 100 to compensate for this loss of energy. This may be done in a variety of ways, including using energy generated when the coil 135 interacts with the magnet (s) 140 or by harvesting solar energy from light near the rocker 100. For example, the voltage that is generated when the coil 135 is swept through the magnetic field may be amplified to compensate for energy loss due to friction and then back to the coil 135, which allows for the rocker 100 to run continuously. Very little energy is required and that energy may be supplied by batteries and/or by addition of solar panel(s) 145A and 145B to the rocker 100. Flexible wires 150 may connect the solar panel(s) 145 to an electric circuit (see FIG. 2) and battery to compensate for energy loss due to friction. The solar panels 145A and 145B may harvest light from the room (e.g., sunlight or room light) and use this energy to maintain the oscillations of the rocker 100. The additional energy needed to compensate for the energy loss due to friction may be stored in a rechargeable battery that may be coupled to the solar panels or a power amplifier (see FIG. 2).

Figure 2:
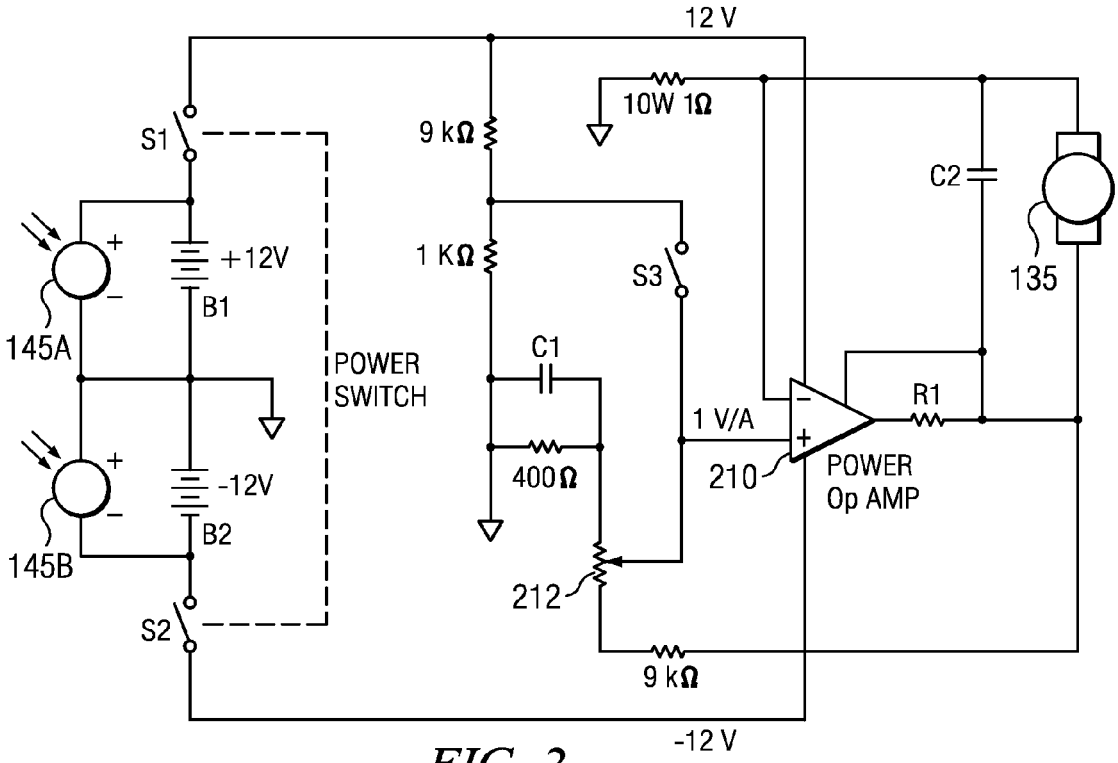
FIG. 2 is an electrical schematic of a circuit to drive the actuator of FIG. 1B.

FIG. 2 illustrates a circuit for driving the actuator coil that may be mounted to the pendulum or to the stationary cross beam 108. A voltage is generated by the coil as it is swept through the magnetic field created by the two permanent magnets (Faraday's induction law), Serway, R. A. and Jewett J. W., *Principles of Physics*, Harcourt Brace Jovanovich, San Diego, 2002; Halliday, D., Resnick, R. and Walker, J. *Fundamentals of Physics*, Wiley, New York 1997, incorporated by reference in its entirety. This voltage is amplified and fed back to the coil. By adjusting the amount of amplification, the circuit adds just enough additional energy to compensate for the energy loss caused by air and bearing friction. In this way, the pendulum can be kept swinging.

In the circuit shown, a power amplifier 210 (a power operational amplifier) amplifies the voltage produced by the coil 135. A 500 Ω 10 turn potentiometer 212 is used to adjust the amount of amplification (gain). The two 10 μcapacitors C1 and C2 stop high frequency oscillations in the feedback circuit. A 1 Ω resistor R1 with a 10 W power rating was used to limit the current to about 0.8 A (as specified by the power amplifier specifications). Other resistances complete the circuit in a conventional fashion.

The circuit above also shows the two 12 V solar cells 145A and 145B and the two nickel metal hydride (NiMH) rechargeable batteries B1 and B2 coupled to the circuit through a power switch S1, S2. An on/off swich 53 enables the baby rocker drive circuit to be turned off.

In operation, the rocker is pushed once at the desired swing height. The actuator will then automatically continue to rock the baby at this given swing height.

While this invention has been particularly shown and described with references to example embodiments thereof, it will be understood by those skilled in the art that various changes in form and details may be made therein without departing from the scope of the invention encompassed by the appended claims.

What is claimed is:

1. A rocker comprising:

a fixed support structure;

a resonant pendulum suspended from the fixed support structure, a sear or bed suspended on the pendulum; and a coil coupled to the pendulum having a current therethrough, the current interacting with a magnetic field to supply a Lorentz force to the pendulum to maintain movement of the seat or bed.

2. A rocker as claimed in claim 1 further comprising a battery to power the coil.

3. A rocker as claimed in claim 2 further comprising a solar panel to charge the battery.

4. A rocker as claimed in claim 1 further comprising a solar panel to power the coil.

5. A rocker as claimed in claim 1, wherein the coil is comprised of copper wire.

6. A rocker as claimed in claim 1, wherein said coil is structurally coupled to the pendulum and moves with the pendulum, and said magnetic field is stationary with respect to the fixed support structure.

7. A rocker as claimed in claim 1, wherein said coil generates a current therethrough when moving orthogonally through the magnetic field.

8. A rocker as claimed in claim 1, wherein said magnetic field is formed between magnets and the coil is position between the magnets and has current orthogonal to the magnets.

* * * * *